United States Patent [19]

Krecke

[11] Patent Number: 4,949,515

[45] **Date of Patent: * Aug. 21, 1990**

[54] FASTENING ELEMENT FOR THE CLADDING CONCRETE METHOD OF CONSTRUCTION

[76] Inventor: Edmond D. Krecke, P.O. Box 33, 6315 Beaufort, Luxembourg

[ * ] Notice: The portion of the term of this patent subsequent to Mar. 22, 2005 has been disclaimed.

[21] Appl. No.: 116,075

[22] PCT Filed: Jan. 17, 1987

[86] PCT No.: PCT/EP87/00021

§ 371 Date: Sep. 21, 1987

§ 102(e) Date: Sep. 21, 1987

[87] PCT Pub. No.: WO87/04478

PCT Pub. Date: Jul. 30, 1987

[30] Foreign Application Priority Data

Jan. 23, 1986 [DE] Fed. Rep. of Germany ..... 3601878

[51] Int. Cl.[5] ..... E04B 1/02

[52] U.S. Cl. ..... 52/105; 52/309.12; 52/426; 52/427; 52/563

[58] Field of Search ..... 52/309.12, 426–428, 52/438, 562–565, 571, 699, 701, 105

[56] References Cited

U.S. PATENT DOCUMENTS

| | | | |
|---|---|---|---|
| 1,037,142 | 8/1912 | Hazen | 52/701 X |
| 1,262,212 | 4/1918 | Kosack | 52/562 X |
| 2,181,698 | 11/1939 | Langenberg | 52/258 |
| 3,255,562 | 6/1966 | Altsschuler | 52/427 X |
| 3,827,205 | 8/1974 | Barberg | 52/426 |
| 4,240,233 | 12/1980 | Vercelletto | 52/565 X |
| 4,438,612 | 3/1984 | Bernard et al. | 52/427 |
| 4,642,964 | 2/1987 | Kellison | 52/699 |
| 4,655,014 | 4/1987 | Krecke | 52/107 X |
| 4,706,429 | 11/1987 | Young | 52/309.12 |
| 4,731,968 | 3/1988 | Obino | 52/309.12 |

FOREIGN PATENT DOCUMENTS

| | | | |
|---|---|---|---|
| 0125319 | 10/1982 | European Pat. Off. . | |
| 0153660 | 2/1985 | European Pat. Off. . | |
| 3413550 | 4/1984 | Fed. Rep. of Germany . | |
| 730009 | 8/1932 | France | 52/563 |
| 1089334 | 3/1955 | France | 52/426 |
| 1299616 | 6/1962 | France . | |
| 2361509 | 4/1978 | France | 52/564 |
| 330391 | 4/1958 | Switzerland | 52/426 |
| 137221 | 1/1920 | United Kingdom | 52/426 |
| 176868 | 3/1922 | United Kingdom | 52/426 |

*Primary Examiner*—David A. Scherbel
*Assistant Examiner*—Lan Mai
*Attorney, Agent, or Firm*—Gifford, Groh, Sprinkle, Patmore and Anderson

[57] ABSTRACT

Described is a fastening element for sheathing and thermal insulation components (1) of hard foam material, in particular for the cladding concrete method of construction, which has a plate (6) which can be fixed to the hard foam material component (1) and is provided with extending fastening means (11). The plate (6) is desirably made from concrete and has a groove-and-tongue arrangement (7, 8) which co-operate with corresponding grooves (3) and tongues (4) on the component (1) so that the fastening elements (2) is fixed to the component (1) in such a manner as to be adjustable in respect of height.

13 Claims, 4 Drawing Sheets

Figure 12:
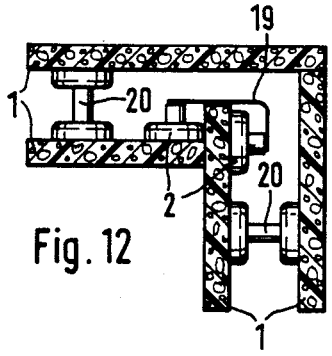

Fig. 1
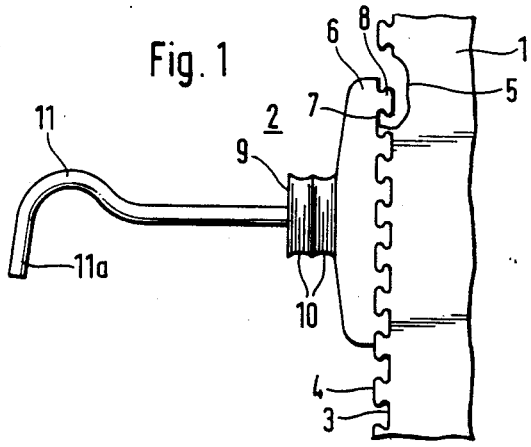
Fig. 2
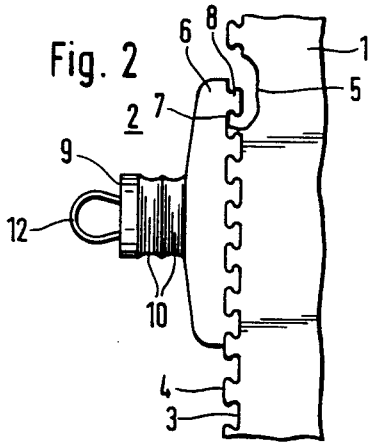
Fig. 4
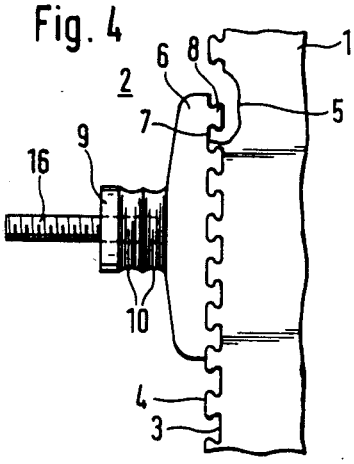
Fig. 4a
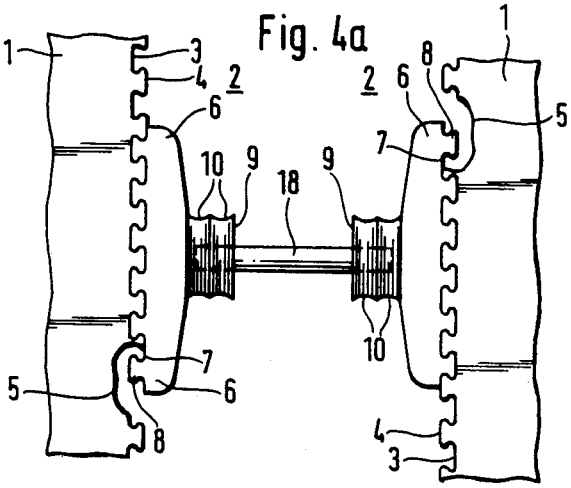
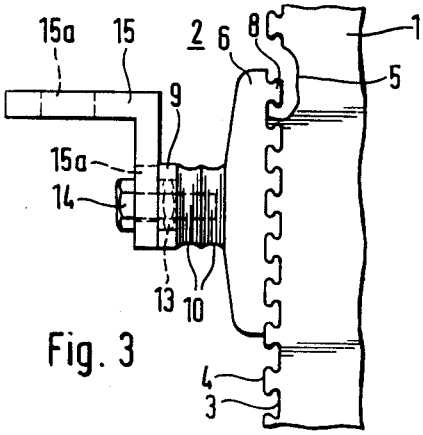
Fig. 3
Fig. 5
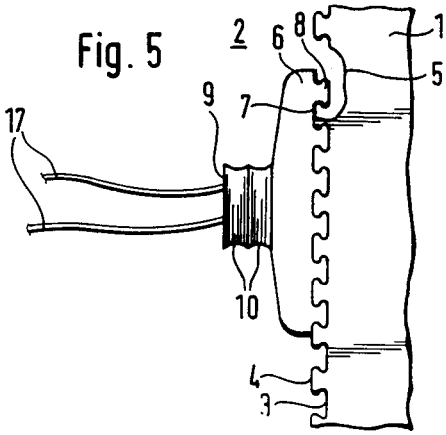

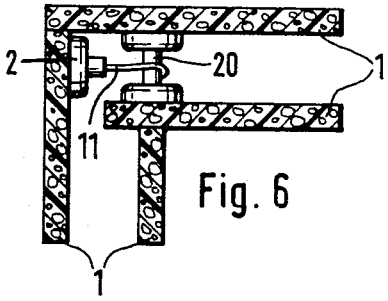
Fig. 6
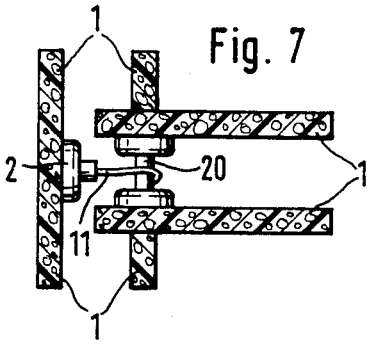
Fig. 7
Fig. 8
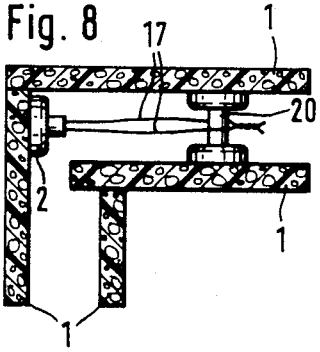
Fig. 9
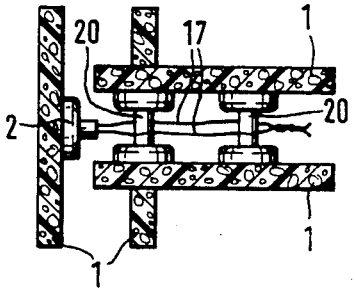
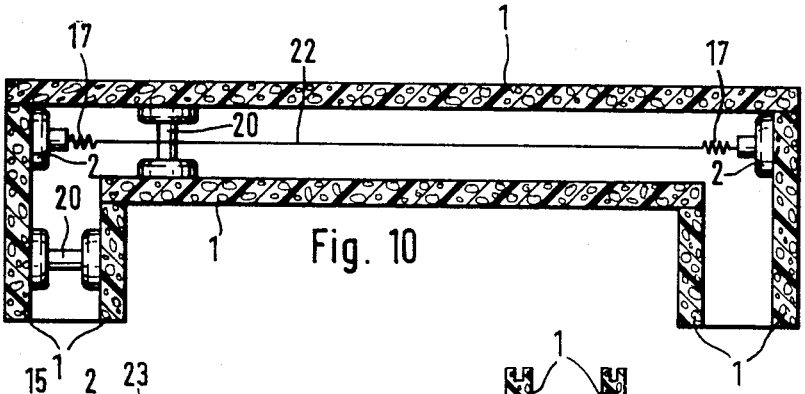
Fig. 10
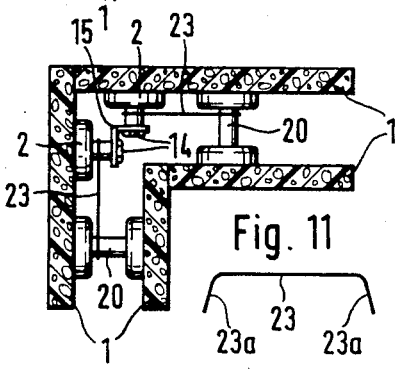
Fig. 11
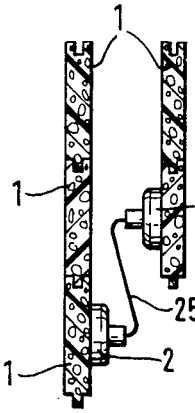
Fig. 14

FASTENING ELEMENT FOR THE CLADDING CONCRETE METHOD OF CONSTRUCTION

The invention relates to a fastening element for sheathing and thermal insulation components of hard foam, in particular for the cladding concrete method of construction.

In known manner (German published specification (DE-AS) No. 26 18 125 and German laid-open application (DE-OS) No. 34 05 736), the cladding concrete method of construction uses large-size sheathing elements of hard foam material which are provided at their edges with grooves and tongues for securing them in position and which are filled with concrete after having been erected in an associated structure. Because of the high levels of forces which occur in that situation connecting elements are used in known manner between the side walls, which engage the inward sides of the side walls, for example in the form of groove-and-tongue connections, or are also secured by adhesive means. While smooth walls are comparatively easy to deal with, when using the cladding concrete method of construction, particular difficulties occur at corners, angles, at connections between walls, at door and window opening lintels and like locations because in that case free-standing or exposed portions of sheathing elements have to particularly supported and secured. As similar point applies when panels of hard foam material are to be used as barrier panels for thermal insulation purposes.

The invention is accordingly based on the object of providing a fastening element for sheathing and thermal insulation components of hard foam, which can be to universal use, which avoids fire and cold bridges and which is cheap and easy to produce. The invention also seeks to improve and supplement the sheathing elements themselves.

To attain that object, the present invention takes as its basic starting point a fastening element of the kind set forth in the opening part of this specification, and is characterized by a plate which can be fixed to the component of hard foam material and which is provided with extending fastening means.

Similarly to when using the known connecting arms of rigid shape and length for connecting the side surfaces of sheathing elements, plates in accordance with the invention permit a connection over a large area to the surfaces of sheathing and thermal insulation components of hard foam material, in which case a large number of conventional and different fastening means make it easily possible to fix the plates in position and therewith the hard foam components to other structures.

There are numerous options which are the subject-matter of further developments of the invention, for carrying the invention into effect in a practical fashion. Thus the plate on the one hand and the hard foam component on the other hand may be provided with corresponding retaining means which are advantageously formed for example by spaced-apart continuous grooves in one member, for example the plate, and corresponding web portions in the other member, for example the hard foam component. In that connection the cross-section of the grooves may be complementary to the cross-section of the respective web portions remaining between each two adjacent grooves. In order to provide a connection which can resist a pulling force, the grooves are desirably of a widened configuration at their bottom. The continuous grooves and web portions permit displacement and thus any desired positioning of the plates with their fastening elements. The cross-sectional shape of the grooves and web portions is to be of such a size that the frictional forces which occur prevent unintentional displacement even when the arrangement is subjected to vibration, or when a jet of concrete impinges thereon, when introducing the concrete.

The plate may be of any shape but is alos preferably in the form of a plate or disc member and on its rear side which faces away from the hard foam component, carries the respective fastening means which are arranged in, at or on a rearward shank portion of the plate. The material used or manufacturing the plate and the shank portion is in particular concrete so that the fastening element then subsequently forms one piece with the site concrete which is introduced in the sheathing elements. That also avoids weakening the concrete wall in regard to fire penetration.

There are a large number of options in regard to the configuration and mounting of the fastening means. Thus one or more binding wires may be anchored in the shank portion, which permit a connection to adjacent components, in such a manner as to withstand a tensile force. The fastening means may also be in the form of a straight or deformed bar which is anchored in the shank portion. The bar may be a round or a flat bar. A deformed bar may form for example a hook or an open or closed eye.

Another option in regard to a fixing means provides that a screwthreaded nut or a screwthreaded rod can be fixed in the shank portion. By means of screws or nuts respectively it is then possible to provide for a fastening to or by means of any other components, for example angle members, perforated strips or the like, while spacing adjustments are also possible by means of the screwthreads.

The shank portion is advantageously provided with at least one and preferably two adjacent peripherally extending grooves into which reinforcing iron members can be inserted, with the position and the spacing thereof from the outside surface of the concrete being precisely fixed. Two adjacent grooves permit the adjacent insertion for example of a horizontal and a vertical reinforcing bar.

A further embodiment of the invention provides that two plates are combined together to form a pair by way of a deformable connecting portion. In that connection straight steel bars of different lengths make it possible to produce connecting portions for the side walls of sheathing elements of any desired internal width. It is therefore possible easily to produce concrete walls of any desired thickness which also differs from standard dimensions. The connecting portion may also be of such a shape that the plane of the two plates forms a desired angle relative to each other, for example an angle of 90° for the connection between an outside wall and an inside wall which connects perpendicularly thereto. Other angles permit the connection of ledges or cornices.

If as the fastening means a bar extends from the shank portion substantially parallel to the plane of the plate towards one side, it is possible to provide for a ceiling closure structure in a particularly advantageous manner by the bar being embedded into the concrete of the block under the ceiling. An extension portion of the bar, which is bent over towards the plate, on the other side of the shank portion, makes it easier to set down ceiling elements, acting as a kind of insertion funnel. That will be described in greater detail hereinafter with reference to the drawings.

In a development of the invention, it is also possible for a plurality of plates to be combined together to form a respective common connecting element, for example when a particular configuration, for example a curve in the case of a wall, is to be built.

A particular embodiment of the invention provides a sheathing element of hard foam for the cladding concrete method of construction with side walls which have equally spaced-apart grooves which extend downwardly and which are distributed over the entire inside surface of the side walls, wherein a plate of hard foam which is arranged between the side walls is provided at the edges adjoining the side walls with web portions which correspond to the grooves. In that way it is possible for the plate to be displaced in respect of height in the grooves any desired manner, and, irrespective of the standard height of the respective sheathing elements, it is possible to produce for example bearers or lintel blocks of the respective height required having regard to static considerations. The plate which forms the bottom in the sheathing element and which by virtue of its position determines the height for example of the bearer or the lintel block may at the same time be the cover of a roller blind box which is arranged under a closing or terminal block. In that arrangement, end walls arranged between the side walls of the sheathing element and provided with web portions, corresponding to the grooves of the side walls, may accommodate roller blind fittings for mounting a roller blind, while te fittings have anchoring portions which project through the end walls and which are to be embedded into the concrete to be introduce, of the adjoining elements.

Taken overall the fastening, sheathing and heat barrier elements according to the invention permit very flexible use of the cladding concrete method of construction, wherein even complicated forms can be rapidly and reliably produced in a reproducible manner. Although the sheathing elements are produced with predetermined pattern dimensions and also the grooves and web portions have a predetermined smaller pattern arrangement within the sheathing elements, it is possible to build in a pattern-free manner for both abutting walls and also corners do not need to keep to the pattern, as will be described in greater detail hereinafter. Free-standing surfaces of sheathing elements of hard foam may be secured by means of the fastening elements according to the invention in such a way that no deformation phenomena occur when filling even high walls. Because of the displaceability in respect of height of the fastening elements, and the floor and ceiling panels of hard foam between the side walls, it is also possible to produce any desired heights as between the standard or pattern dimensions of sheathing elements.

Figure 19:
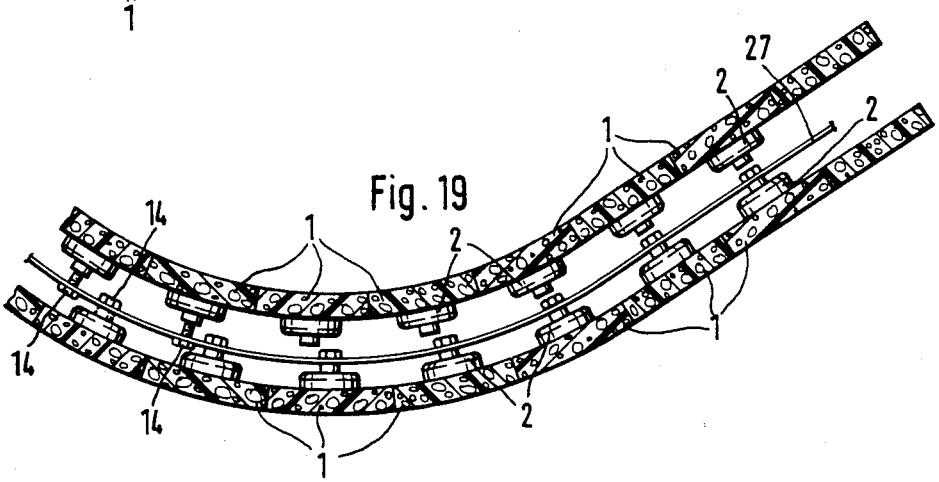
Figure 20:
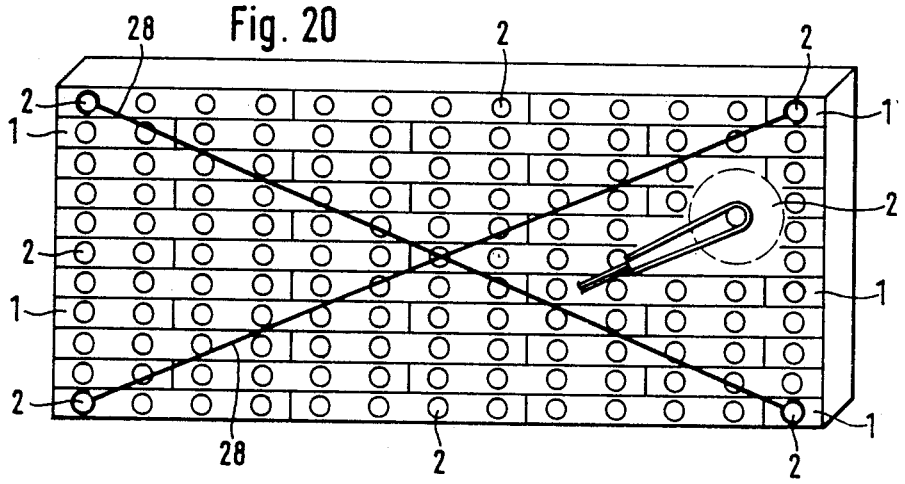
Figure 21:
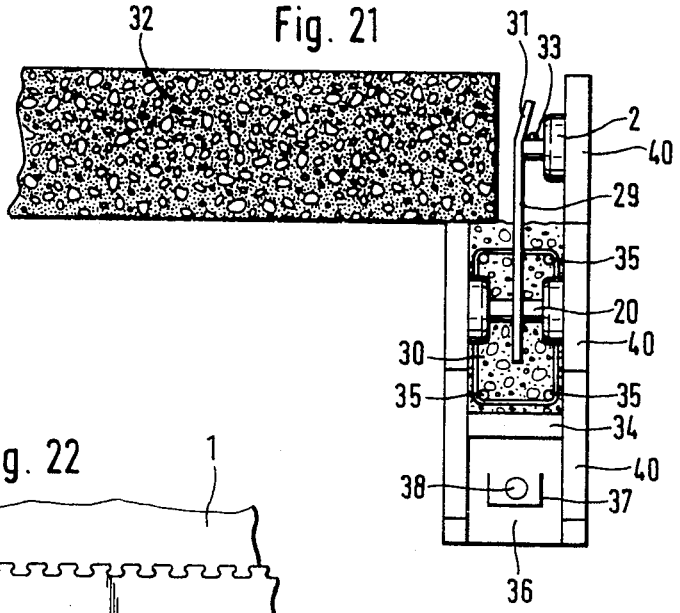
Figure 22:
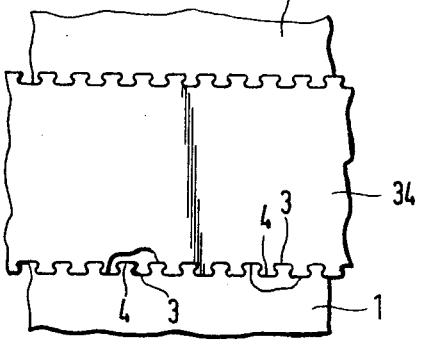

The invention is described hereinafter by means of embodiments with reference to the accompanying drawings in which:

FIGS. 1 through 5 show embodiments of fastening elements according to the invention, which are arranged at the grooved inward side of a sheathing component of hard foam material, FIGS. 6 through 19 show the use of fastening elements according to the invention in a number of different wall shapes and with different functions, FIG 20 is a diagrammatic view of the strutting or bracing of a wall of sheathing elements, for storm securing purposes, FIG. 21 shows a ceiling-wall connection, using components according to the invention, and FIG. 22 shows a bottom which is displaceable in respect of height of a sheathing element, as an embodiment of the invention.

FIGS. 1 through 5 each diagrammatically shows a section of a sheathing component 1 of hard foam material for the cladding concrete method of construction, on which fastening elements 2 according to the invention are arranged. The sheathing components 1 have parallel grooves 3 and tongues 4 of an undercut and symmetrical rounded-off profile. As can also be seen particular from the part 5 of the sheathing component 1, which is broken away for illustrative purposes, a place 2, in the form of a plate or disc member, of the fastening element 2 is provided with grooves 7 and tongues 8 which also extend continuously and which are of the same form and size as the grooves 3 and 4 of the componen 1. As the grooves 3 and the tongues 4 of the component 1 extend over the entire height thereof, the fastening element can be adjusted to any desired height after being inserted into the grooves and tongues. The plate 6 of the fastening element 2 has a shank portion 9 which is made in one piece from concrete, together with the plate 6. The shank portion 9 has two grooves 10 extending therearound, into which reinforcing bars and fastening members can be introduced in a secured position, for example a horizontal bar or rod and a vertical bar or rod (not shown).

Fixed in the shank portion 9 are extending fastening means, being for example anchored therein by being cast therein, or being fixed by adhesive. In that respect FIGS. 1 through 5 show examples of such fastening means, namely a hook 11 of structural steel of for example a diameter of 10 mm in FIG. 1, a closed eye 12 in FIG. 2, a screwthreaded nut 13 with screw 14 for fixing an angle member 15 in FIG. 3, a screwthreaded rod 16 in FIG 4 and binding wires 17 in FIG. 5. The hook 11 in FIG. 1 which is shown turned through 90° for illustrative purposes is fitted with its slightly outwardly projecting end for example into one of the grooves 10 of a further fastening element 2 and pulls it towards itself when the hook 11 is pressed downwardly with its plate 6 in the grooves 3. The angle member 15 is provided on its two limb portions with slots **15*a* so as to permit movements for fitting thereof. FIG. 4*a* diagrammatically illustrates the way in which it is possible to produce connecting arms for sheathing elements of any desired width, by means of connecting rods or bars 18 of different lengths, which can also be embodied using screwthreaded rods in accordance with the embodiment shown in FIG. 4**.

FIG. 6 diagrammatically illustrates the construction of a wall corner using a fastening element in accordance with the invention. The inside walls of two sheathing components 1 of hard foam material are properly cut in matching relationship in such a way that a continuous concrete corner configuration can be formed after filling the structure with site concrete. A connecting web 20 with connecting plates which can be of the same configuration as the plates 6 shown in FIGS. 1 through 5 and with a one-piece connecting shank portion made from concrete between the plates provides for fixing the spacing between the inside and outside walls of the upper sheathing component 1. The free outside wall of the lower sheathing component 1 which must withstand a high pressure after the introduction of concrete is fixed to the connecting web 20 by a fastening element 2 according to the invention which has a hook 11 as shown in FIG. 1.

FIG. 7 shows the point at which for example an inside wall (horizontal) connects to an outside wall (vertical). The inside surface of the sheathing component 1 of the outside wall is provided with a cut-out portion into which the sheathing component 1 of the inside wall projects. A connecting web or arm 20 secures the sheathing component 1 of the inside wall in the cut-out portion in the outside wall and at the same time represents the connecting point for a fastening element 2 with hook 11 as shown in FIG. 1. In spite of the coarse and fine pattern configurations which are predetermined by the grooves 3, 4 of the sheathing elements 1 and the dimensions thereof, it is possible to form any desire connection between inside and outside walls, independently of the pattern configuration, because the sheathing component 1 of the inside wall can be arranged in any desired manner in the cut-out portion in the outside wall.

FIG. 8 diagrammatically shows a further embodiment of a corner structure similar to that shown in FIG. 6. However instead of a fastening element 2 with hook 11, this arrangement uses a fastening element 2 with binding wires 17 as shown in FIG. 5, which are fixed to a connecting web or arm 20. In this case also the corner can be produced irrespective of the predetermined pattern configurations because the binding wires permit any desired distance setting.

FIG. 9 shows a modification of the junction between inside and outside walls as in FIG. 7. In this case also the fastening element 2 is fixed by binding wires 17 as shown in FIG. 5 to a further connecting web or arm 20. In this case also it is possible to have any desired distance setting.

FIG 10 shows a wall construction with two corners which, in a modification of the embodiments shown in FIGS 6 and 8, have a tension wire 22 between two fastening elements 2, each having one or two binding wires 17.

Figure 13:
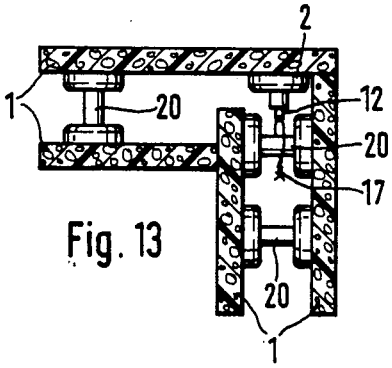

FIGS. 11, 12 and 13 show three further embodiments for constructing a wall corner. In that case, in FIG. 11 the two outside walls of the sheathing components 1 are secured together by a pair of fastening elements 2 which are connected together by way of an angle member 15, in accordance with the embodiment shown in FIG. 3. Additional securing of the corner structure is effected by two loop members 23 of the shape separately at bottom right in FIG. 11. In a similar manner to the hook 11 in FIG. 1, the loop members 23 which are made for example from structural steel of a diameter of 8 mm have end portions 23*a* which are bent over at an inclined angle and with which they engage into grooves 10 in the fastening elements 2 and the connecting webs 20 respectively. In the embodiment shown in FIG. 12, the inside walls of sheathing components 1 are connected by two fastening elements 2 which are connected by way of a bent rod or bar 19 of structural steel. The outside corner may additionally be secured in the manner shown in FIG. 11. In the case of the corner structure shown in FIG. 13, a fastening element 2 with eye 12 as shown in FIG. 2 is used for fixing the outside wall of a sheathing component 1.

Figure 15:
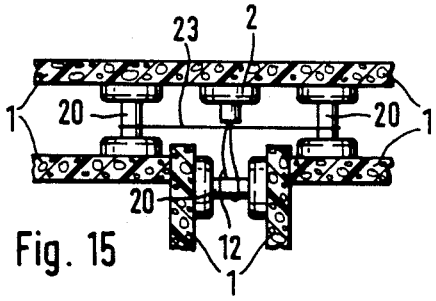

FIG. 15 shows a force-locking connecting between an outside wall (horizontal) and an inside wall communicating therewith (vertical), similarly to FIGS. 7 and 9. In this case tow connecting webs or arms 20 are drawn together by a steel loop member 23 which can also be replaced by a binding wire and at the same time the inside wall which extends into the outside wall is secured to a connecting web or arm 20 by a fatening element 2 and a binding wire 17, as shown in FIG. 5.

Figure 16:
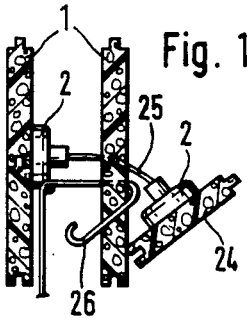
Figure 17:
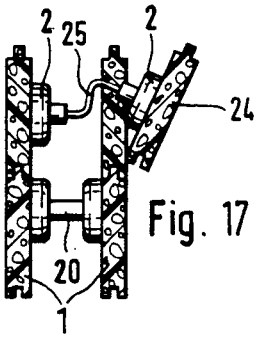

FIGS. 16 and 17 diagrammatically show the production of ledges or cornices of different angles of inclination, wherein a sheathing plate 24 is fixed to a sheathing component 1 by means of a pair of fastening elements 2 and the connection between the two fastening elements 2 is made by way of a suitably bent rod or bar 24 which may also be replaced by a perforated sheet. The plate, which is towards the ledge or cornice, of the sheathing element 1 is sawn away in the region of the fastening element 2 on the panel 24 so that it is possible to produce a bond with the reinforced concrete (an additional reinforcing element 26 is shown in FIG. 16) of the wall.

Figure 18:
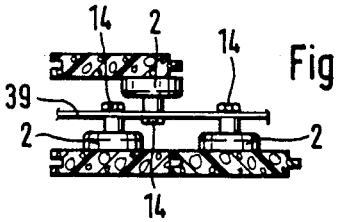

FIG. 18 shows the way in which it is possible by means of fastening elements 40 as shown in FIG. 3 or FIG. 4 to produce a connection which is adjustable in respect of its spacing between two sheathing panel of a sheathing component 1. FIG. 19 shows a curved portion of wall which is made up of a number of arcuately curved sheathing components 1 whose walls are held at the correct and adjustable angle (see the left-hand corner) by fastening elements as shown in FIGS. 3 and 4 and a sheet metal strip which is provided with slots, connecting them.

FIG. 20 diagrammatically shows how a wall built from a number of sheathing components and prepared for the casting of concrete therein is strutted or braced by diagonally extending bracing cables for storm securing purposes or also for precise alignment thereof. The cables 28 are fixed in the four corners to fastening elements 2. For that purpose it is possible to use the fastening elements with binding wires as shown in FIG. 5, or as shown at the right in FIG. 20 on an enlarged scale, the cables 28 are simply laid around the shank portion 9, more particularly in a groove 10.

FIG. 21 shows a ceiling closure sheathing element 40 which is arranged on a sheathing component 1 disposed therebelow, by means of a fastening element 2, as an embodiment of the invention. For that purpose the fastening element 2 has a connecting member 29 of structural steel, which extends into the concrete of the subjacent lintel block 30 or, at other points of the ceiling 32, of a normal block or other element. The connecting member is fixed on a shank portion 9 as shown in FIGS. 1 through 5 and is extended upwardly by a bent portion 31. The latter serves as an aid when fitting ceiling panels 32, to assist with the entry thereof. The connecting member 29 is also resilient so as to avoid damage in the fitting operation. The plate 40 which is provided with grooves 3 and tongues 4 as shown in FIGS. 1 through 5 can also be pulled out when fitting the ceiling, in order also to avoid damage. A reinforcing rod or bar 33 which is part of a ring anchor is inserted in positioned relationship into a groove 10 in the fastening element 2. After the space between the ceiling 32 and the plate 40 has been filled, a continuous connection is made to the lintel block or the normal wall and, reinforced by means of the bent portion 31, to the component disposed thereabove.

The lintel block 30 is defined downwardly by a plate 34 which is shown in greater detail in FIG. 22. The height of the block 30 can be adjusted, depending on the static requirements involved, by the plate being displaced by means of a groove-and-tongue configuration 3 and 4 at be edges thereof in the corresponding grooves 3 and tongues 4 of the sheathing component 1. As shown in FIG. 21, the reinforcing cage which is arranged in the block 30 and which is formed from bars 35 may be higher than a standardized sheathing component 1. Connecting webs or arms 20 of concrete and possibly also fastening elements 2 do not interfere with the reinforcement or strengthening structure.

A roller blind box is provided beneath the plate 34. For that purpose, two terminal or end walls 36 which are arranged between the walls of the lowermost sheathing component 1 which serves as the roller blind box each have a mounting 37 (shown only in diagrammatic form) for the ball bearing assembly 38 of the roller blind casing (not shown). The mounting 37 extends with an anchoring means (not shown) through the end wall 36 into the free space in the next sheathing component which is then filled with site concrete, securing the anchoring member in place. Accordingly the adjustable-height wall 34 is both the bottom of the lintel block 30 and also the top or cover of the roller blind box.

I claim:

1. A fastening element for use in forming concrete wall structure within sheathing components wherein said sheathing components and the fastening elements comprise mutually interlocking members for fixedly joining the fastening elements to said components, said fastening element being formed of concrete and comprising a plate-like member having on one side thereof a surface configuration adapted to form an interlocking contact with a corresponding facing surface configuration on a sheathing component, said fastening element having a shank on a second side thereof, fastening means fixed to said shank and adapted to interconnect one sheathing component to a second sheathing component for fixing said components relative to each other to receive concrete between said components.

2. A fastening element as set forth in claim 1 characterized in that the said surface configuration is formed by equally spaced-apart continuous grooves.

3. A fastening element as set forth in claim 1 characterized in that the fastening means comprises binding wires anchored in the shank portion.

4. A fastening element as set forth in claim 1 characterized in that the fastening means comprises a bar anchored in the shank portion.

5. A fastening element as set forth in claim 4 characterized in that the bar forms a hook.

6. A fastening element as set forth in claim 4 characterized in that a portion of the bar, anchored in the shank, extends substantially parallel to the plane of the plate-like member from one side of said shank (9).

7. A fastening element as set forth in claim 6 characterized in that the bar (29) is bent over (31) on an other side of said bar towards the plate-like member (6).

8. A fastening element as set forth in claim 1 characterized in that the fastening means include a screwthreaded element fixed in the shank portion.

9. A fastening element as set forth in claim 1 characterized in that the shank portion is provided with at least one groove extending therearound.

10. A fastening element as set forth in claim 1 characterized in that two plate-like members are combined together to form a pair by way of a deformable connecting portion.

11. A connecting element as set forth in claim 1 characterized in that the planes of the two plate-like members are displaced through 90° relative to each other.

12. A fastening element as set forth in claim 1 characterized in that it comprises a plurality of plate-like members combined by means of a common connecting element fixed to respective ones of the fastening means.

13. The fastening element of claim 1 wherein said shank is formed intricately with said plate-like member and is positioned substantially centrally of said second side of said plate-like member.

* * * * *